US007587986B2

(12) United States Patent
Neidert et al.

(10) Patent No.: US 7,587,986 B2
(45) Date of Patent: Sep. 15, 2009

(54) MODULAR PERSONAL PONTOON BOAT

(75) Inventors: David R. Neidert, Mantua, UT (US); Kelly A. Harward, Layton, UT (US); Edward G. VanNimwegen, North Ogden, UT (US)

(73) Assignee: Tillicum International, Inc., Mantua, UT (US)

( * ) Notice: Subject to any disclaimer, the term of this patent is extended or adjusted under 35 U.S.C. 154(b) by 0 days.

(21) Appl. No.: 11/728,704

(22) Filed: Mar. 26, 2007

(65) Prior Publication Data

US 2007/0249246 A1 Oct. 25, 2007

Related U.S. Application Data

(60) Provisional application No. 60/785,561, filed on Mar. 24, 2006.

(51) Int. Cl.
*B63B 1/00* (2006.01)

(52) U.S. Cl. ..... 114/61.15; 114/352; 114/354

(58) Field of Classification Search ..... 114/61.1, 114/352, 353, 354, 61.15; 297/283.1, 283.2, 297/440.14, 440.15, 440.24
See application file for complete search history.

(56) References Cited

U.S. PATENT DOCUMENTS

| | | | | | |
|---|---|---|---|---|---|
| 237,495 | A | * | 2/1881 | Darcy | 297/283.1 |
| 2,394,764 | A | * | 2/1946 | Greulich | 114/267 |
| 2,990,804 | A | * | 7/1961 | Garehime | 114/283 |
| 3,672,723 | A | * | 6/1972 | Decursu et al. | 297/440.24 |
| 4,295,236 | A | * | 10/1981 | Upchurch | 114/357 |
| 4,315,475 | A | | 2/1982 | Echols | |
| 4,700,648 | A | | 10/1987 | Trefethern et al. | |
| 4,768,456 | A | | 9/1988 | Jones et al. | |
| 4,823,717 | A | * | 4/1989 | Roberson | 114/61.1 |
| 5,290,196 | A | | 3/1994 | Steel | |
| 5,517,934 | A | | 5/1996 | Brown | |
| 5,540,169 | A | | 7/1996 | Davis et al. | |
| 5,692,450 | A | | 12/1997 | Alter et al. | |
| 6,173,671 | B1 | | 1/2001 | Casull | |
| 6,311,632 | B1 | | 11/2001 | Noel, Jr. | |

(Continued)

*Primary Examiner*—Stephen Avila
(74) *Attorney, Agent, or Firm*—Thorpe North & Western LLP

(57) ABSTRACT

A modular personal flotation system comprising, at least in part, rigid, seamless, non-woven modules, such as a seat module and various pontoon modules, formed by the process of rotational molding or blow molding, from a Linear Low Density Polyethylene (LLDPE), High Density Polyethylene (HDPE), or similar molding resin. The pontoon modules each have a rigid shape, which makes it both unnecessary to inflate and vastly improves the resistance to loss of flotation, creating safer conditions for the user. The pontoon modules are also tolerant of significant relative pressure changes without substantial deformation or change in its shape. Vent hole(s) formed during the molding process are closed to water ingestion via a low-cost bleeder valve assembly. An integral luggage rack can also be molded as part of the center seat module, positioned behind the seat. Open drain holes molded through the seat module double as slots to receive a backpacking harness. The seat module is removably coupled to the pontoon modules by complementary integrally-formed connection interfaces, or by a system of nylon straps with hook and loop fastening sections, eliminating the need for multiple components and fasteners, thus saving weight, complexity, and cost. In an alternative embodiment, a metal frame module may be interposed between oversized pontoon modules and the seat module to configure a flotation system capable of supporting more weight.

22 Claims, 15 Drawing Sheets

U.S. PATENT DOCUMENTS

| | | | | |
|---|---|---|---|---|
| 6,345,581 | B2 | 2/2002 | Blanchard | |
| 6,526,904 | B2 | 3/2003 | Liston et al. | |
| 6,752,097 | B1 | 6/2004 | Elson et al. | |
| 6,755,142 | B2 | 6/2004 | Rice | |
| 6,929,521 | B2 | 8/2005 | Howerton | |
| 7,014,266 | B2 * | 3/2006 | Selby | 297/423.16 |
| 2001/0023658 | A1 | 9/2001 | McInnes | |
| 2004/0011934 | A1 * | 1/2004 | Czepowicz et al. | 248/311.2 |

* cited by examiner

MODULAR PERSONAL PONTOON BOAT

RELATED APPLICATIONS

This application claims the benefit of U.S. Provisional Patent Application Ser. No. 60/785,561, filed on Mar. 24, 2006, and by reference is incorporated in its entirety herein.

FIELD OF THE INVENTION

The present invention relates to portable watercraft or floatation devices, and more particularly to personal pontoon boats.

BACKGROUND OF THE INVENTION AND RELATED ART

Lightweight and portable flotation devices, including pontoon boats, kick boats, float tubes, etc. have been increasingly popular in recent years, particularly with sport fishermen and white-water enthusiasts. Most of these devices rely upon inflatable tubes, pontoons, or bladders that consist of a thin, flexible membrane filled with pressurized air. These prior art devices are very lightweight and easily portable, and may be folded into a relatively compact shape. Prior art pontoons which are formed of a thin membrane such as vinyl are typically 0.015 inch thick. Others, such as polyurethane film are even thinner, such as about 0.009 inch. Such pontoons are generally uniform in thickness throughout, and are frequently heat-welded together from several flat pieces to form the tubular shape.

Because they are relatively thin, typical float tubes and pontoons are highly susceptible to puncture, such as from snagging fish hooks, rocks, branches, etc. Additionally, the sections of their construction are typically heat-welded together, creating seams that can present inherent weakness. Because of their thinness and pliability, when typical pontoons are punctured, they can collapse and lose their buoyancy. They can also be difficult to repair. Typical thin membrane pontoons are repaired in a manner similar to bicycle or automobile tires, using patches and chemical adhesives. Once repaired, the membrane may not be as strong as it was before.

Additionally, typical float tubes and pontoons are very susceptible to changes in temperature and barometric pressure. For example, many users first inflate their boat in the morning, when temperatures are cool. Then, by afternoon, when the ambient temperature has increased, the pontoon pressure will have increased such that air must be released from the pontoon to prevent it from bursting. When temperatures decrease again later in the day and toward evening, the pontoon pressure likewise drops, and the boat may no longer provide sufficient buoyancy.

Similarly, many pontoon boat users inflate their pontoons before leaving home, and then drive into a mountainous region at much higher altitude. In the course of gaining altitude, the barometric pressure and temperature will typically drop, increasing the relative pressure inside the pontoons, sometimes enough to cause the pontoon to burst.

Another problem with many prior art pontoons is that they are unnecessarily complex in their design.

SUMMARY OF THE INVENTION

In light of the problems and deficiencies inherent in the prior art, the present invention seeks to overcome these by providing a modular personal flotation system, otherwise known as a pontoon boat or kick boat. The pontoon boat of the present invention comprises various modules, preferably molded in sections, that are fittable together to form one or more variants of a modular personal flotation system. For instance, the pontoon boat may comprise two separate rigid pontoon modules able to couple to and function with a separate seat module or seat assembly, also preferably molded. Each pontoon module may comprise cavities formed therein to accommodate gear and accessories, such as an asymmetric clover leaf rod or net holder. The rigid pontoon design makes inflation unnecessary and provides durability characteristics that make it particularly resistant to punctures.

The present invention features a modular personal pontoon boat that is portable and that comprises multiple modules, each having its own functional structure. For instance, the seat module has a functional structure configured to support a person on the pontoon boat, while the rigid pontoon modules have a functional structure to support both the seat module and an individual about the water. The modules of the pontoon boat are designed and intended to be removably coupled together, thus providing a break-down function and/or facilitating interchangeability with other modules. For instance, the seat module or seat assembly may be configured to detach from the pontoon modules in order to facilitate efficient transport in a vehicle or efficient storage. Alternatively, a damaged pontoon module may be easily interchanged with a new pontoon module.

The seat module may comprise a single structural component with no removable or assembled parts. Or, it may be made up of a plurality of components that fit together to form the seat module or at least a portion thereof. For instance, the seat may have a detachable seat back section. The seat module may couple directly to the pontoons, or it may couple to an intermediate frame module, which in turn is coupled to the pontoon modules. The seat module may be designed to hold one or more individuals, and may comprise various different ergonomic designs. The seat module may further comprise a luggage rack formed in the seat back section.

The pontoon modules comprise a hollow structure with a cavity formed therein, which cavities are designed to hold air. The pontoon modules further comprise a wall that defines the cavity, and that has a shape in the form of a tubular pontoon. The pontoons may also comprise one or more vent holes formed in the wall designed to facilitate the intake or purging of air. One or more fittings may be used to seal the vent holes and to prevent water from entering the vent holes during use of the pontoon boat. The fittings may be comprised of a sealing plug bonded into the vent hole, with a central bleeder screw that can be selectively removed by the user to allow the pontoon internal air pressure to equalize with ambient air pressure. This may be advantageous when shipping the pontoons as different destinations may have significantly different temperature or elevation changes.

The modularity of the pontoon modules allows them to be symmetrically configured so as to be interchangeable side to side and reversible front to back. Both ends of the pontoon modules may be given identical rounded, blunt shapes to remove the distinction between the bow end and stern end, and further allowing the pontoon modules to perform equally well during movement about the water in either direction.

In one exemplary embodiment the means for removably coupling the first and second rigid pontoon modules to the seat module may be integrally-formed with the modules themselves, such that each module is a self-contained unit which contains both the functional structure and the connection interface. In the case of the integrally-formed connection interface, the interface may be made from the same materials as the functional structure of the modules, or it could be made from a different material which is integrated into the operating structure either during or after its manufacture.

In another exemplary embodiment, the means for removably coupling the modules together comprises a flexible strap having hook and loop, snaps, buckles, or other similar types of fasteners operable therewith. For instance, the first and second rigid pontoon modules may be connected to the seat module by a system of low-cost nylon straps having hook and loop-type fastening strips, making for a secure assembly during use, while also enabling quick disassembly for transport or storage purposes. These straps can be used with a one-piece seat module, which eliminates complex connection systems typical of prior art pontoon boats or kick boats.

Alternatively, the straps can be configured to attach the pontoon modules to the seat module via an intermediate frame module, typically made of metal, which provides a connection interface altogether separate from the molded modules. The use of a metal frame module is particularly useful with larger models capable of supporting one or more occupants and having pontoon modules of greater size and flotation capacity.

The present invention further overcomes many of the problems of the prior art by providing a pontoon boat having various attractive design features. In some exemplary embodiments, the pontoon boat may comprise various modular components or modules comprised of rigid, seamless, hollow cavities, preferably formed by rotational or blow molding of a LLDPE (Linear Low Density Polyethylene) or HDPE (High Density Polyethylene) material.

BRIEF DESCRIPTION OF THE DRAWINGS

The present invention will become more fully apparent from the following description and appended claims, taken in conjunction with the accompanying drawings. Understanding that these drawings merely depict exemplary embodiments of the present invention they are, therefore, not to be considered limiting of its scope. It will be readily appreciated that the components of the present invention, as generally described and illustrated in the figures herein, could be arranged and designed in a wide variety of different configurations. Nonetheless, the invention will be described and explained with additional specificity and detail through the use of the accompanying drawings in which:

DETAILED DESCRIPTION OF EXEMPLARY EMBODIMENTS

Figure 1:
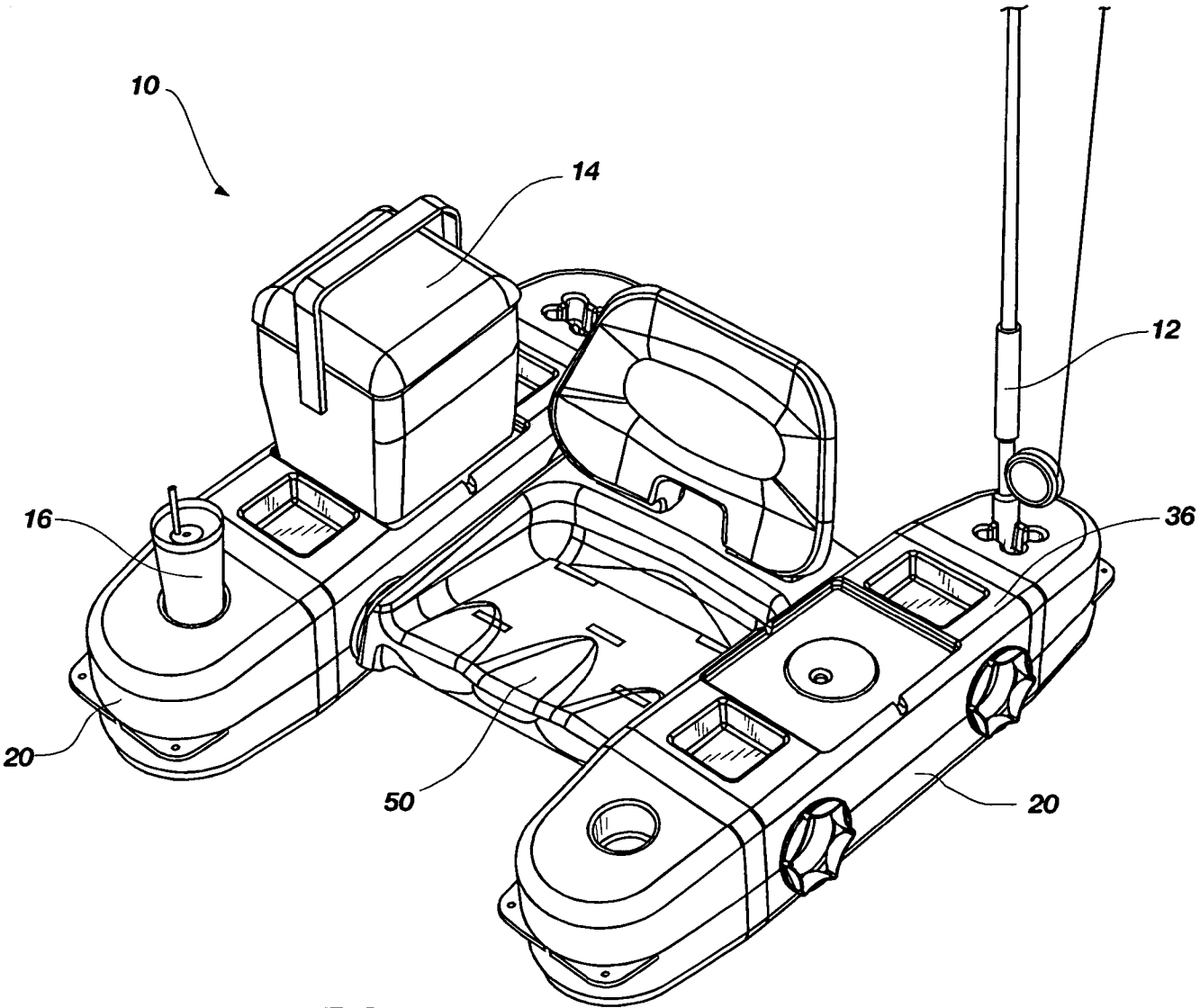
FIG. 1 illustrates a perspective view of a modular pontoon boat in accordance with one exemplary embodiment of the present invention.

The following detailed description of exemplary embodiments of the invention makes reference to the accompanying drawings, which form a part hereof and in which are shown, by way of illustration, exemplary embodiments in which the invention may be practiced. While these exemplary embodiments are described in sufficient detail to enable those skilled in the art to practice the invention, it should be understood that other embodiments may be realized and that various changes to the invention may be made without departing from the spirit and scope of the present invention. Thus, the following more detailed description of the embodiments of the present invention is not intended to limit the scope of the invention, as claimed, but is presented for purposes of illustration only and not limitation to describe the features and characteristics of the present invention, to set forth the best mode of operation of the invention, and to sufficiently enable one skilled in the art to practice the invention. Accordingly, the scope of the present invention is to be defined solely by the appended claims.

Furthermore, the following detailed description and exemplary embodiments of the invention will be best understood by reference to the accompanying drawings, wherein the elements and features of the invention are designated by numerals throughout.

The present invention describes a modular personal flotation system, otherwise known as a pontoon boat or kick boat, comprising a plurality of modular components fittable together to form one or more variants of a rigid pontoon boat. At least two of the modular components are rigid pontoons that can be attached to a seat module by a variety of means, including a connection interface which has been integrally formed into each module.

The modular pontoon boat of the present invention provides several significant advantages over prior related inflatable pontoon boats and kick boats, some of which are recited here and throughout the following more detailed descriptions. First, a rigid pontoon has superior durability characteristics to that of inflatable pontoons, such as being virtually immune to punctures, thus improving water safety for users. Other advantages of a rigid structure include not requiring periodic inflation and/or deflation, being more tolerant of significant relative temperature and pressure changes than inflatable pontoons, and not substantially deforming in shape. Second, by being formed from a plurality of modules, the pontoon boat may comprise several different design variants. Indeed, it is contemplated that each modular component or module may comprise several different designs, each being interchangeable and fittable together to form one or more pontoon boat variants. And lastly, by forming the connection interface integral with the modules the total number of parts can be reduced and assembly of the individual modules into a pontoon boat can be simplified.

Each of the above-recited advantages will be apparent in light of the detailed description set forth below, with reference to the accompanying drawings. These advantages are not meant to be limiting in any way. Indeed, one skilled in the art will appreciate that other advantages may be realized, other than those specifically recited herein, upon practicing the present invention.

With reference to FIG. 1, an exemplary embodiment of the modular personal flotation system 10 comprises first and second rigid pontoon modules 20 and a seat module or seat assembly 50. The means for removably fastening the pontoon modules to the seat module will be shown forthwith in the following drawings. The top surface 36 of the pontoon module can be formed with a variety of specialized recesses for securing and keeping readily available equipment and gear commonly used by sport fishermen, such as a fishing rod 12, an ice chest 14 or a drinking cup 16.

The user can normally propel the small pontoon boat using swimming fins or flippers—hence the name, "kick boat." Although not to be considered limiting in any way, the exemplary modules making up the various rigid pontoon boat variants are preferably comprised of rigid, seamless components, formed of a relatively thick LLDPE or HDPE polymer material, and having unique shape and features described in the claims.

Given the design, the pontoon boat described is almost completely resistant to loss of flotation. The rigid configuration of the pontoon portions of the structure also makes them relatively immune to pressure variations. Consequently, if a boat is transported when temperatures are low, the boat will keep its shape and not fail when ambient temperature increases or outside pressure drops significantly. This allows the boat to retain its full buoyancy in a much wider variety of conditions where a thin membrane inflatable boat will vary widely in its performance, sometimes requiring periodic inflation or deflation.

Several different processes may be used to form the pontoon boat modules, such as by rotational molding or by blow molding. In the rotational molding process, the polymer material in the form of a powder is placed inside a mold. The mold is then heated as it is rotated, causing the powder to melt inside, and form the desired item. Regulation of the temperatures of various portions of the mold can be used to control the wall thickness of the resulting product. Higher temperature areas produce a greater thickness than lower temperature areas.

Figure 2:
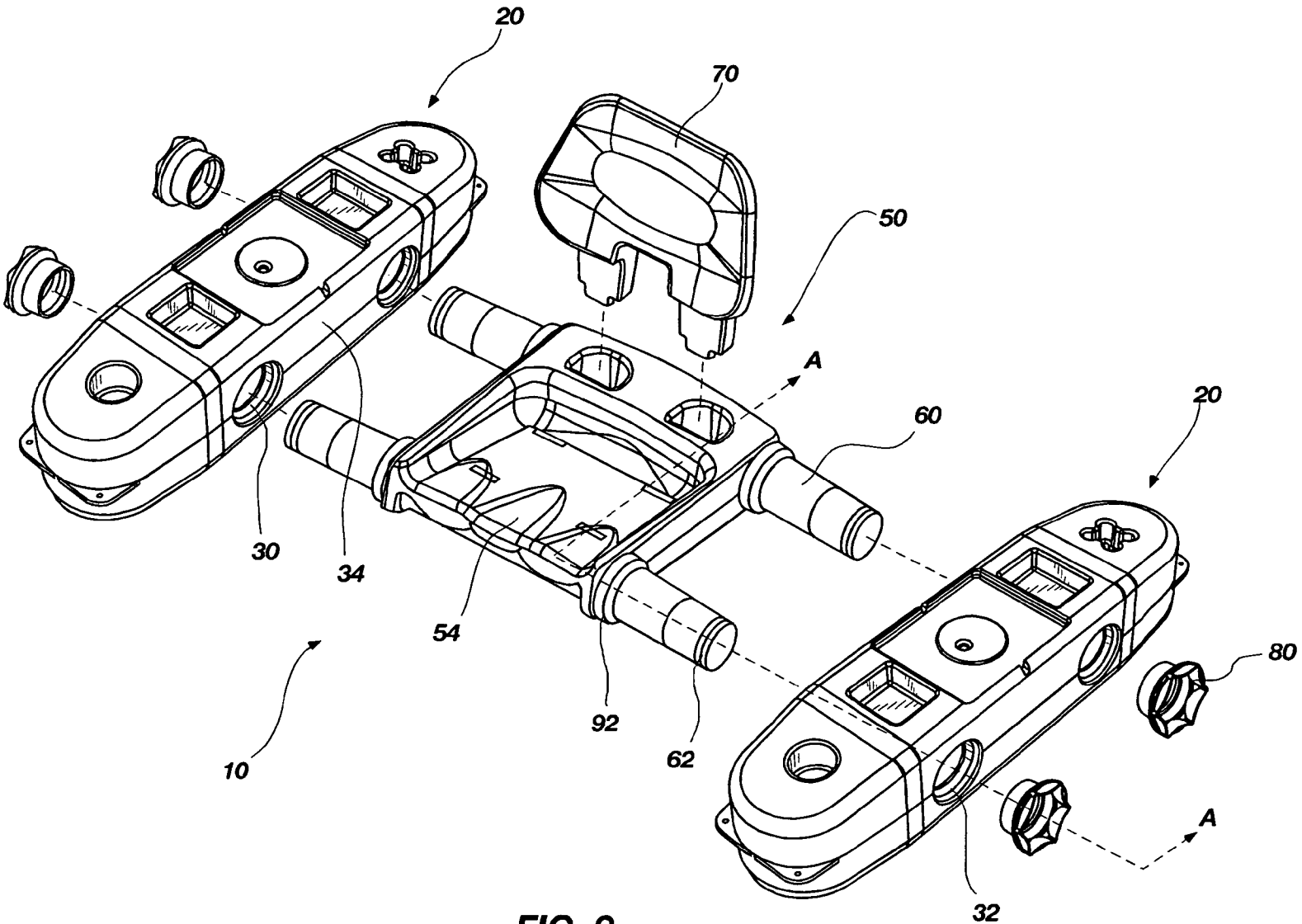
FIG. 2 illustrates an exploded, perspective view of the embodiment shown in FIG. 1.

Although the portable pontoon boat as described is preferably made of a LLDPE resin suitable for rotational molding, or HDPE for blow molding, other materials exhibiting similar capabilities will be readily substitutable and are contemplated herein FIG. 2 is an exploded view of the exemplary embodiment 10 shown in FIG. 1 and is illustrative of the integrally-formed connection interface which can connect the pontoon modules 20 to the seat module 50. Each pontoon module can have a number of interior passages 30 or slots formed in the sidewalls which can be configured to receive a connection post 60 extending from the seat module. In the exemplary embodiment shown, the interior passages are sealed and pass all the way through each pontoon module to exit the far sidewall. However, in other embodiments the interior passage may not pass all the way through the pontoon module, but instead may terminate after proceeding a minimum distance into the module necessary to establish a connection strong enough to support the combined weight of the seat module and an occupant. The interior passages can also have tapered faces 32 inside the openings on both sides of the pontoon module to provide positive contact against complementary tapered surfaces of the seat module or threaded connector 80.

Also shown in FIG. 2 is the seat module 50 which can be separated into a seat bottom 54 and a seat back 70. The seat bottom can be formed from the same material as the pontoon modules and can be sealed and hollow to provide a portion of the buoyancy for the complete modular flotation system. Likewise, the seat back can also be formed of the same material as the pontoon modules and can be coupled to the seat bottom using another variation of an integrally-formed connection interface.

In the illustrated exemplary embodiment the seat bottom is configured with four connecting posts, two per side, which are configured to fit snuggly inside complementary interior passages formed in the pontoon modules. The connection posts have threaded ends 62 configured to be rotationally engaged by a threaded connector 80. Upon assembly and tightening, the threaded connector pushes upon the tapered surface 32 just inside the opening of the interior passage, forcing the pontoon module to ride directly onto the connection post and creating a frictional locking force between the outer surface of the connection post and the inner surface of the interior passage. Tightening the threaded connector can also press the tapered surface in the opposite opening of the interior passage directly against a complementary tapered surface 92 at the base of the connecting post. This supplements the frictional locking force created within the interior passage of the rigid pontoon module.

Figure 3:
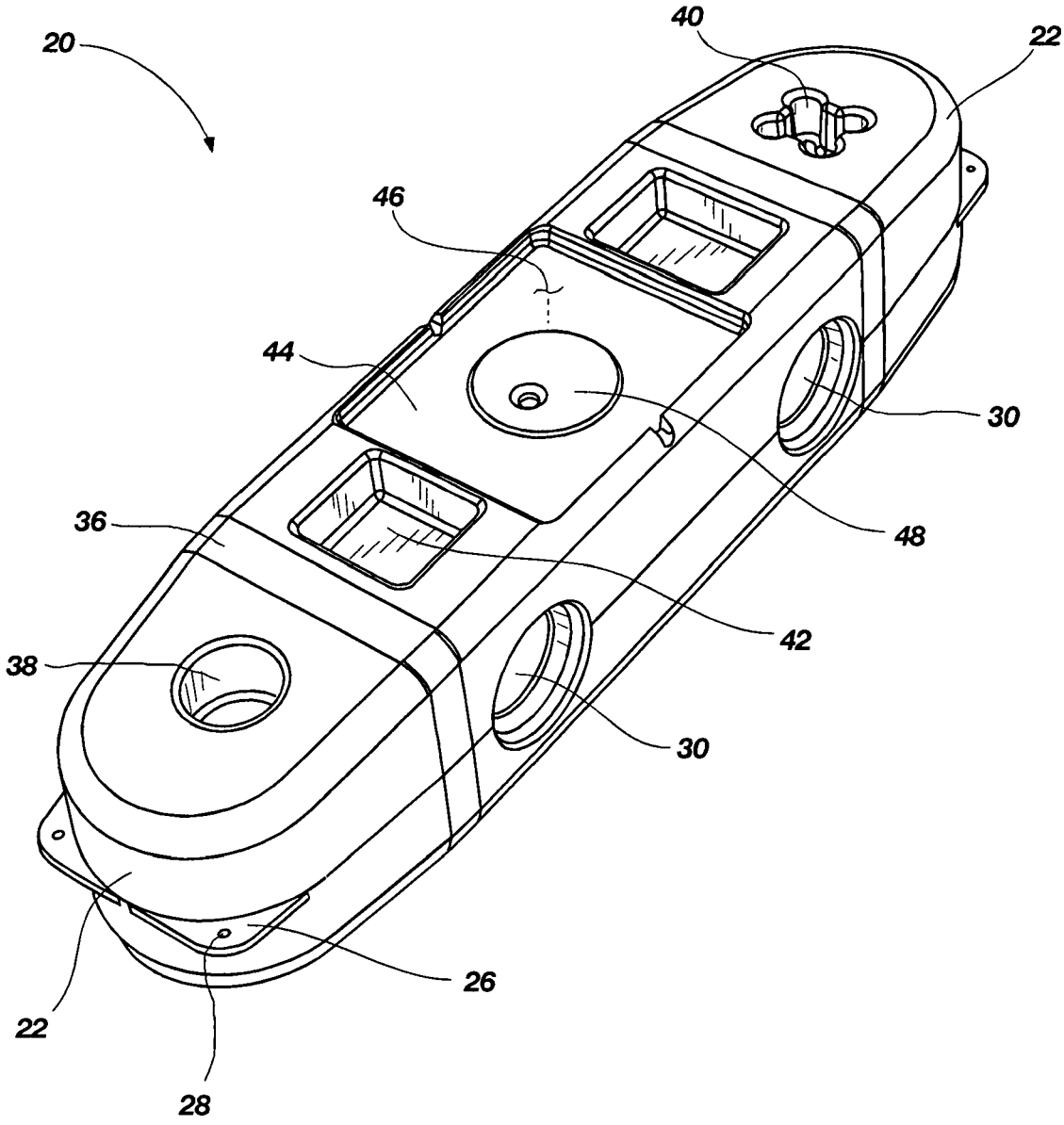
FIG. 3 illustrates a perspective view of a pontoon module in accordance with the embodiment of FIG. 1.

The rigid pontoon module 20 of the present invention is shown in FIG. 3. The pontoon modules each comprise a wall that defines their shape and internal cavity, and that are extremely resistant to punctures. The pontoon modules are capable of indefinitely retaining the air within their cavities. Advantageously, and unlike prior related designs, the pontoon sections require no inflation, such as via an air pump or air compressor. In addition, the walls can withstand relative pressure changes without substantial change or deformation in their shape. The top surface 36 of each pontoon module is contoured to be parallel to the water surface, and is uniquely equipped with specialized recesses to receive and stabilize equipment such as a fishing pole, a fish net, a small plastic tackle box, a fish finder, a dry box, a six-pack beverage cooler, and/or a cup or mug. These recesses can include a cup holder 38, a rod and net holder 40, a storage bin 42, and an ice chest/utility box holder 44.

Moreover, the pontoon modules may also be formed so as to comprise different sized and configured compartments molded inside the pontoon, such as a dry storage compartment 46 which is accessible through a friction plug 48. The compartments may be used to secure and protect various items such as clothing or valuables from accidental loss or moisture.

The end sections 22 of the pontoon modules taper to rounded, blunt ends that enable the pontoon boat to be more easily propelled through the water via flippers. In one aspect, both ends of the pontoon modules may be given the identical shape, the distinction between a bow end and a stern end being removed and the pontoon modules being able to perform equally well during movement about the water in either direction. Moreover, the symmetrical configuration of the end sections facilitates interchangeability side to side and reversibility front to back with respect to the seat module. The end sections can also be formed with corner flanges 28 having holes providing additional functionality, such as allowing the user to attach a cord to tie off the pontoon boat while in the wilderness or store the pontoon boat when not in use.

According to an exemplary embodiment of the present invention, the two interior passages 30 can be configured with different offset distances between the centerlines of the interior passages and the centerline of the pontoon module, which in effect moves the center of gravity of the assembled flotation system slightly away from the centerline of the pontoon module. By combining this feature with the capability of reversing the pontoon modules front to back, the assembled flotation system can provide multiple trim adjustments to better accommodate users of different sizes, shapes and weights.

Given the rigid and durable design, these pontoons are almost completely resistant to loss of flotation. The rigid configuration of the pontoons also makes them resistant to pressure variations. Consequently, if a pontoon is inflated at low altitude or when temperatures are low, the pontoon will keep its shape and not burst when ambient temperature increases or outside pressure drops significantly. This allows the pontoon to retain its full buoyancy in a much wider variety of conditions where a thin membrane inflatable will vary widely in its performance, sometimes requiring periodic inflation or deflation.

The end sections 22 are preferably thicker, or comprise an increased wall thickness, than the remainder of the pontoon. This thickness makes the end sections more resistant to damage from impact, etc., which is a high safety concern with inflatable pontoons. In addition, the end sections can be identically-shaped to allow the pontoon modules to be reversible front to back and interchangeable side to side with respect to the seat module.

The polymer material of the pontoons is easier to repair than prior art pontoons. They are molded of a thermoplastic material, when if cut or punctured, may be repaired simply by applying heat. Simply pressing a hot knife or other item against the damaged area causes the polymer material to bond together, usually resulting in a repair that is just as strong as the original undamaged material. Moreover, there is no need for unsightly patches, chemical adhesives, and the drawbacks that are associated with them. For additional repair strength, it is also possible to add more polymer material to the damaged area during the heating repair process.

Alternate processes are used to form the pontoon, by rotational molding or by blow molding. In the rotational molding process, the polymer material in the form of a powder is placed inside a mold. The mold is then heated as it is rotated, causing the powder to melt inside, and form the desired item. Regulations of the temperatures of various portions of the mold can be used to control the wall thickness of the resulting product. Higher temperature areas produce a greater thickness than lower temperature areas.

Although the portable pontoon boat as described is made of a LLDPE (Linear Low Density Polyethylene) resin suitable for rotational molding, other materials exhibiting similar capabilities will be readably substitutable. For example, any carbon polymer materials, particularly those suited for blow molding, can form the basic polymeric unit.

Although the embodiments of the invention discussed above and illustrated in the figures describe a modular rigid pontoon boat having two pontoon modules on either side of a removable seat module, wherein the pontoon boat is designed primarily for fishing or hunting, it is contemplated that the present invention may also be configured to form various other pontoon boat variants. For example, the concepts discussed herein may be used to form a pontoon boat used for low impact exercise. In this embodiment, the pontoon modules may be configured differently, if desired, as well as including grab or stability handles to improve kicking efficiency. One skilled in the art will appreciate the design of these and other exemplary embodiments.

Figure 4:
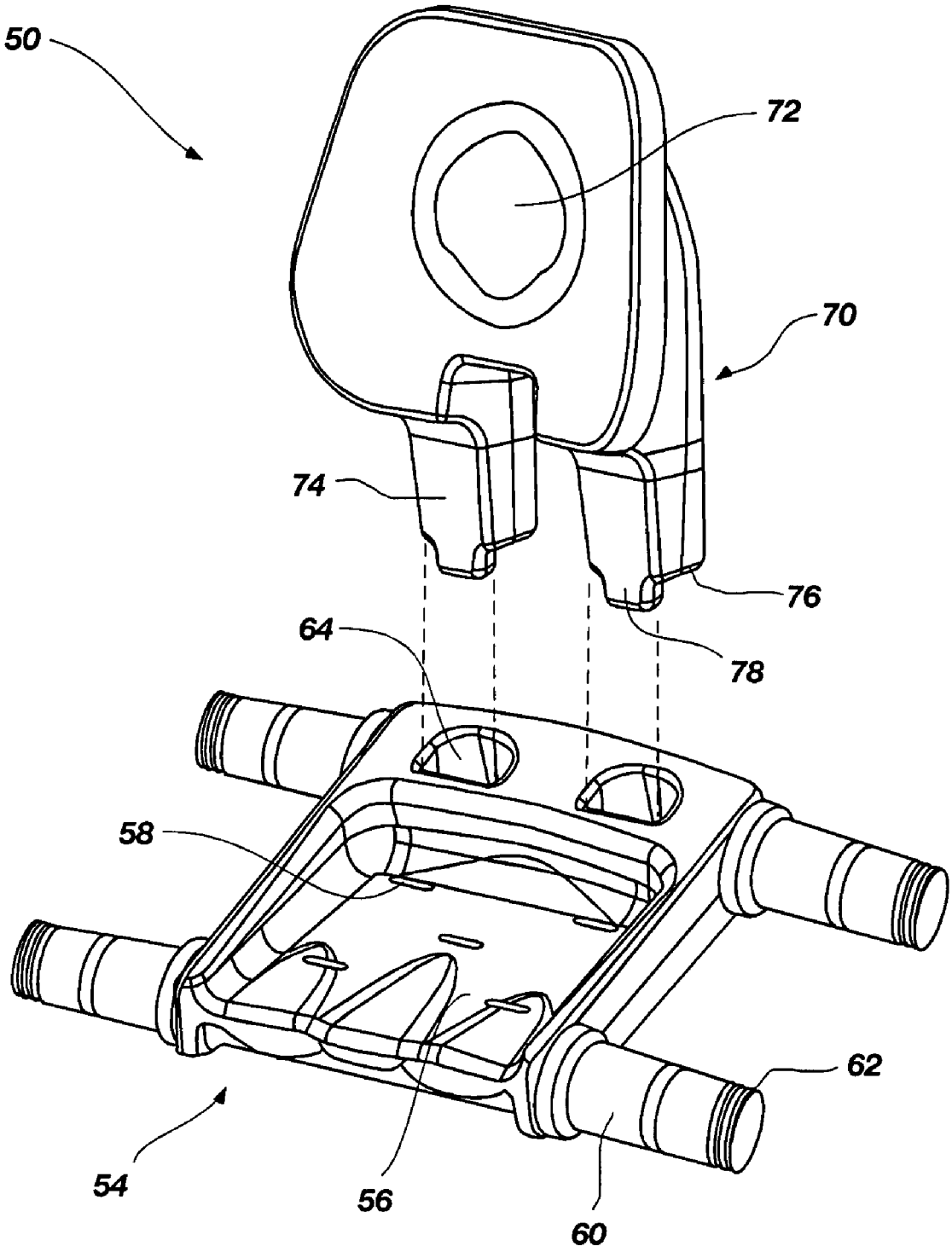
FIG. 4 illustrates an exploded, perspective view of a seat module in accordance with the embodiment of FIG. 1.

The seat module 50 is shown with additional detail in FIG. 4. The seat module can comprise a single, unified structure providing both bottom and back support to an occupant. However, the seat module can also be separated into a seat bottom 54 and a seat back 70, as shown in an exemplary embodiment. Separating the seat module into a bottom portion and a back portion provides several advantages. Firstly, it is easier to package and ship two relatively flat structures than a single rigid seat structure that has an "L" shaped profile. Secondly, it is possible to standardize on a seat bottom configuration while offering a variety of seat back options to better fit the wide range lower back configurations requested by customers. For instance, some users may prefer a flexible seat back face 72 to accommodate a more active fishing and casting style, while others may desire a firmer lumbar support to accommodate health issues with their lower backs. Separating the seat module into two different elements with a standard connection interfaces can better provide for user preferences while minimizing the size of the shipping container. The seat module may further comprise a luggage rack formed in the seat back section.

Referring again to FIG. 4, the seat bottom can have a molded seat 56 formed in the surface thereof to provide comfort to an occupant spending lengthily periods of time in the seat module. The molded seat can also have a series of drain holes 58 formed in its surface to help drain any splash water that may become trapped in the molded bottom. Moreover, if vehicle access to the water is restricted, the drain holes can be configured to double as slots to receive a backpacking harness, which may then be used to carry the pontoon boat over rough terrain by foot. For many adults, the exemplary embodiment of FIG. 1 is light enough to carry for a short distance. The user only needs to attach the backpacking harness.

Moreover, in another aspect, a molded seat of a different size can be formed in the underside of the seat bottom, and the seat bottom can be configured to be reversible top to bottom to provide additional comfort to occupants of various sizes.

In an exemplary embodiment, the seat bottom is configured with four integrally-formed connecting posts 60 which are molded together with the seat bottom. The connecting posts are sized to fit within and extend all the way through the complementary interior passages of the rigid pontoon modules, with two connecting posts per pontoon module. The connecting posts have threaded ends 62 which are attachable by a threaded connector (not shown) which serve to couple and secure the pontoon modules and the seat module together.

Figure 5:
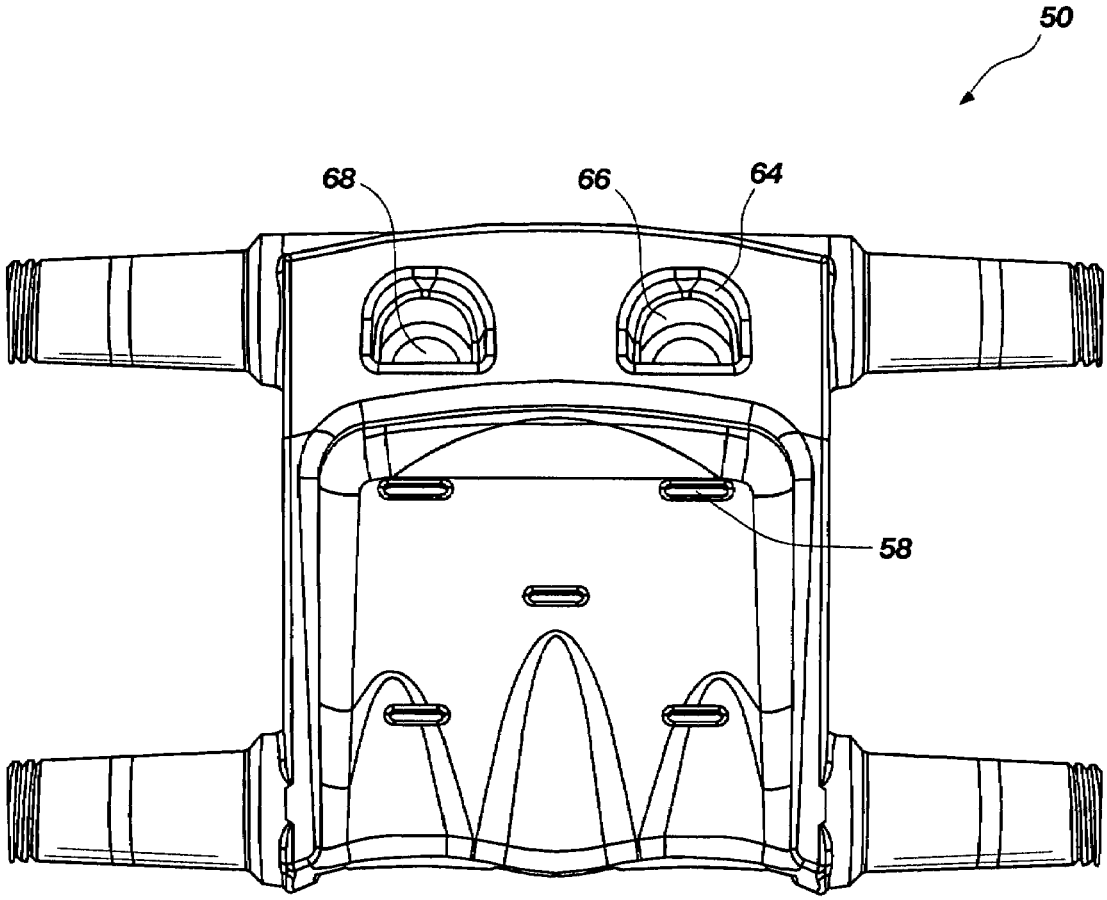
FIG. 5 illustrates a top view of a seat module in accordance with the embodiment of FIG. 1.

The seat bottom can also have an integrally-formed support slot 64 on a top surface which is configured to be removably coupled with the support pedestals 74 of the seat back 70. The support pedestals can have a bottom surface 76 which provides vertical support and alignment for the seat back, and in an exemplary embodiment may also have a detent tongue 78 which extends downward further than the support bottom. As shown in FIG. 5, the detent tongue is configured to engage a mating detent groove 68 located in the bottom of the support slot 64 when the bottom surface of the support pedestal lands against the flat face of the support slot bottom 66.

The detent tongue of the support pedestal can further be configured to snap into a locking position within the detent groove of the support slot. For instance, both the detent tongue and the detent groove can be made of the same rigid thermoplastic used for the pontoon modules, which is rigid against changes in air pressure but slightly flexible under an applied load. Forming a slight protrusion on the surface of either structure which is aligned with a similarly sized and shaped indentation on a complementary surface allows the protrusion to snap into the indentation when the two structures are brought into the proper position. However, the detent tongue can still be pulled away from the detent groove if sufficient force is applied to temporarily deflect the protrusion enough to allow it to slip out of the indentation.

Figure 6:
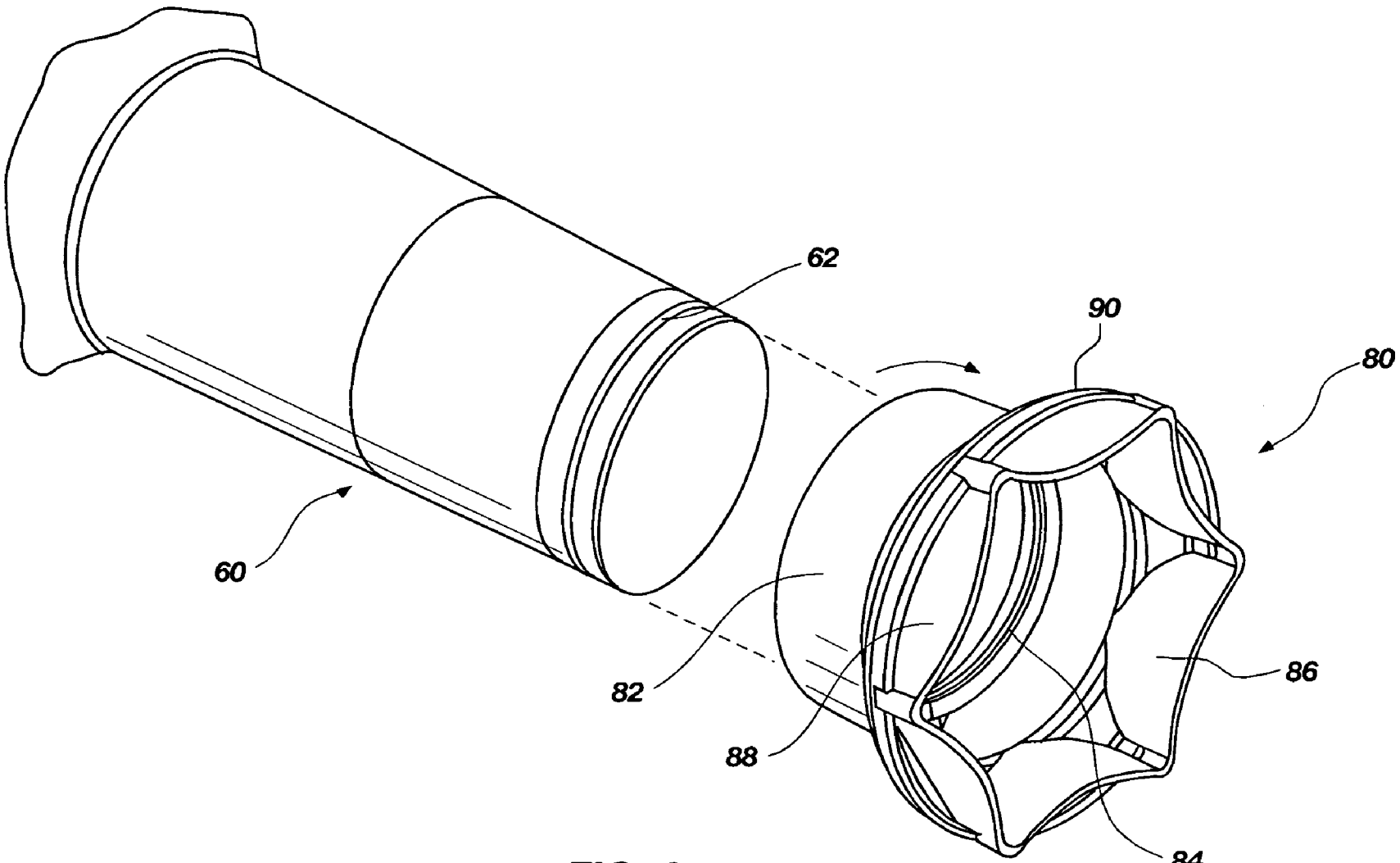
FIG. 6 illustrates an exploded, perspective view of a connection post and threaded connector in accordance with the embodiment of FIG. 1.

FIG. 6 further illustrates the interaction between the connection post 60 and the threaded connector 80. The threaded connector functions in a manner similar to a common wing nut, only much larger. The connector has a tubular body 82 with threads 84 formed in the inner surface. The threads are configured to engage with the threaded end 62 of the connection post. The pitch and length of the threads can be set up to draw the threaded connector up the length of the threaded portion of the connection post with roughly a single rotation of the threaded connector.

The threaded connector has a circular handle 86 which can be used to directly turn the connector by hand, without the requirement for any additional tooling. Indeed, it is desirable to prevent the use of tooling such wrenches and plies which can easily damage thermoplastic components of the exemplary embodiments. Configuring the threaded connector to be hand tightened is a distinct advantage over the prior art as it greatly facilitates the assembly of the modular pontoon boat, especially when assembly transpires in a wilderness setting where tools may not be readily available. The handle can further be sub-divided into a number of curved sections or finger grooves 88 which allow for easier grasping of the threaded connector. The circular handle is connected to the tubular body by a transition portion that comprises a tapered face 90.

Figure 7:
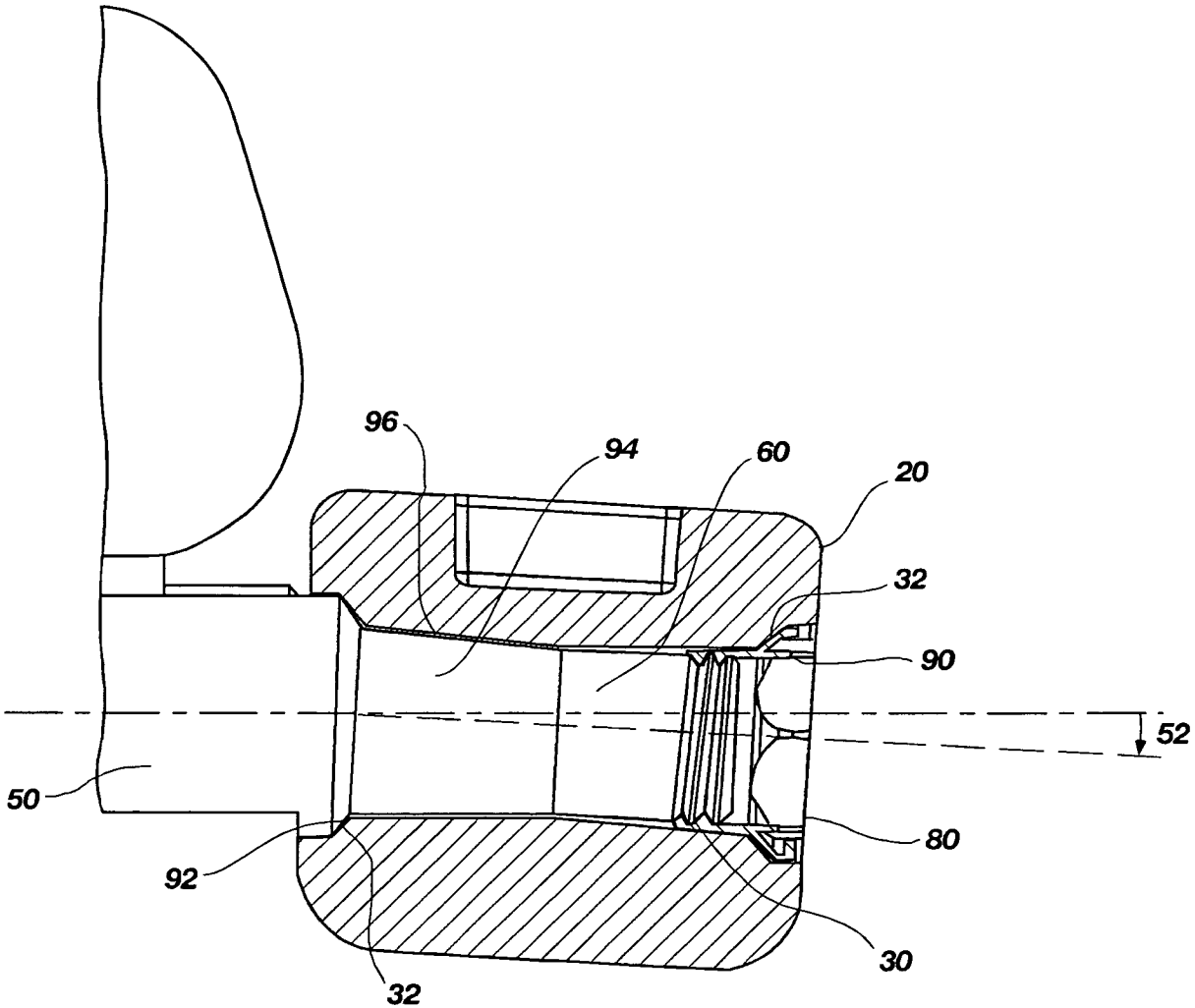
FIG. 7 illustrates a sectional view of a connecting post, threaded connector and pontoon module in accordance with the embodiment of FIG. 1 as seen from Section A-A identified in FIG. 2.

The interaction between the connection post of the seat module, the internal passage of the pontoon module and the threaded connector is shown in the cross-sectional drawing of FIG. 7 as taken along cross-section A-A, originally identified in FIG. 2. In FIG. 7, the connection post 60 of the seat module 50 has been introduced into the internal passage 30 of the pontoon module 20. Threaded connector 80 has also been inserted into the opposite end of the internal passage and rotationally engaged with the threaded end of the connection post, drawing the threaded connector up the connection post until the tapered face 90 of the threaded connector comes into contact with the complimentary tapered face 32 of the pontoon module. Continued turning of the threaded connector forces the pontoon module further up the connection post until the tapered face 32 on the opposite end of the internal passage comes into contact with tapered face 92 at the base of the connection post. Upon reaching this position, the pontoon module becomes firmly attached to the seat module.

The connection post can also have a tapered section 94 have a lesser degree of taper than tapered face 92, but nonetheless is configured to contact a section of the internal passage 96 formed with a matching shallow degree taper. These two surfaces of the connection post and the internal passage can be configured to contact each other simultaneous with the contact of the other tapered faces, but because of the smaller degree of taper the corresponding area of contact is much larger inside the internal passage, and having a greater contact area results in a larger frictional force acting to secure the modules together.

Also illustrated in FIG. 7 is the slight downward incline angle 52 of the connection post 60 relative to the seat module 50 as it extends away from the seat module. The connection post can be given the downward angle to initially orient the pontoon modules 20, or more specifically, to initially orient the top surface 36 of the pontoon modules, on an incline leading away from the seat module. In an exemplary embodiment the downward angle is approximately 3 degrees.

Figure 8A:
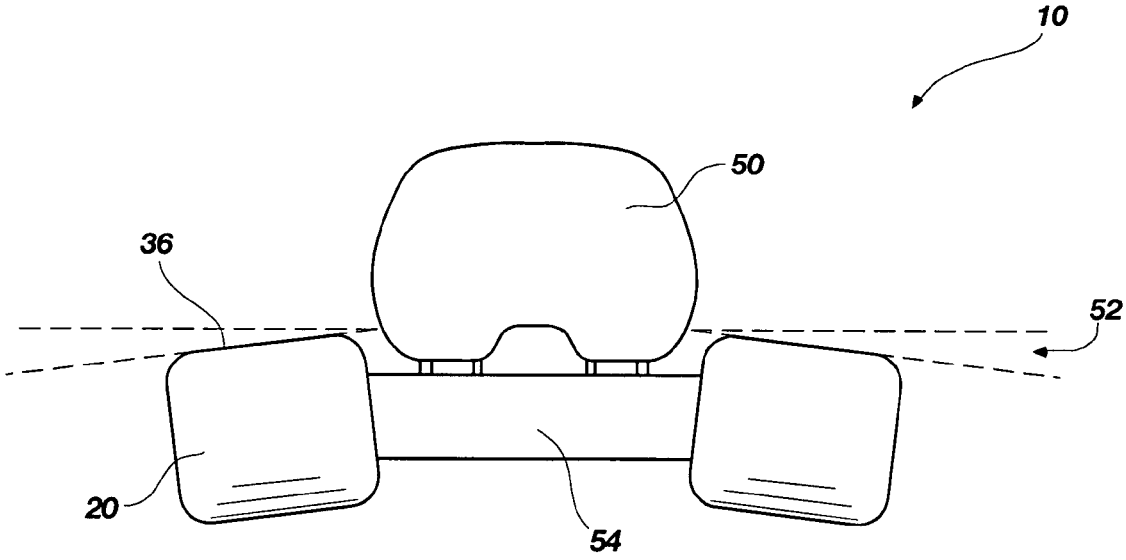
FIG. 8 illustrates front view of the embodiment of FIG. 1 in both an unloaded and a loaded state.
Figure 8B:
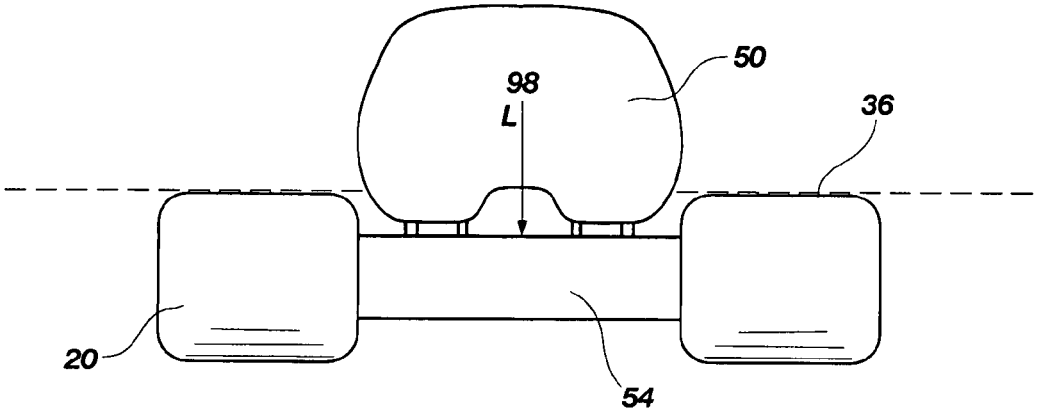

Incline angle 52 is further illustrated in FIG. 8(*a*), which shows an exemplary embodiment of the pontoon boat 10 in which both pontoon modules 20 are given a downward incline relative to the seat module 50, or more particularly, to seat bottom 54. The pontoon modules are configured with an angled alignment to facilitate the leveling of the top surface 36 of the pontoon modules after an applied load 98 has been applied to the seat bottom, as shown in FIG. 8(*b*). Such an applied load can be created by the weight of an occupant. Configuring the connection posts, and therefore the pontoon modules, with an initial incline angle provides advantages over the prior art by compensating for the inherent flexibility in a modular personal flotation system to create a level working surface for occupants of the pontoon boat when in use.

Figure 9:
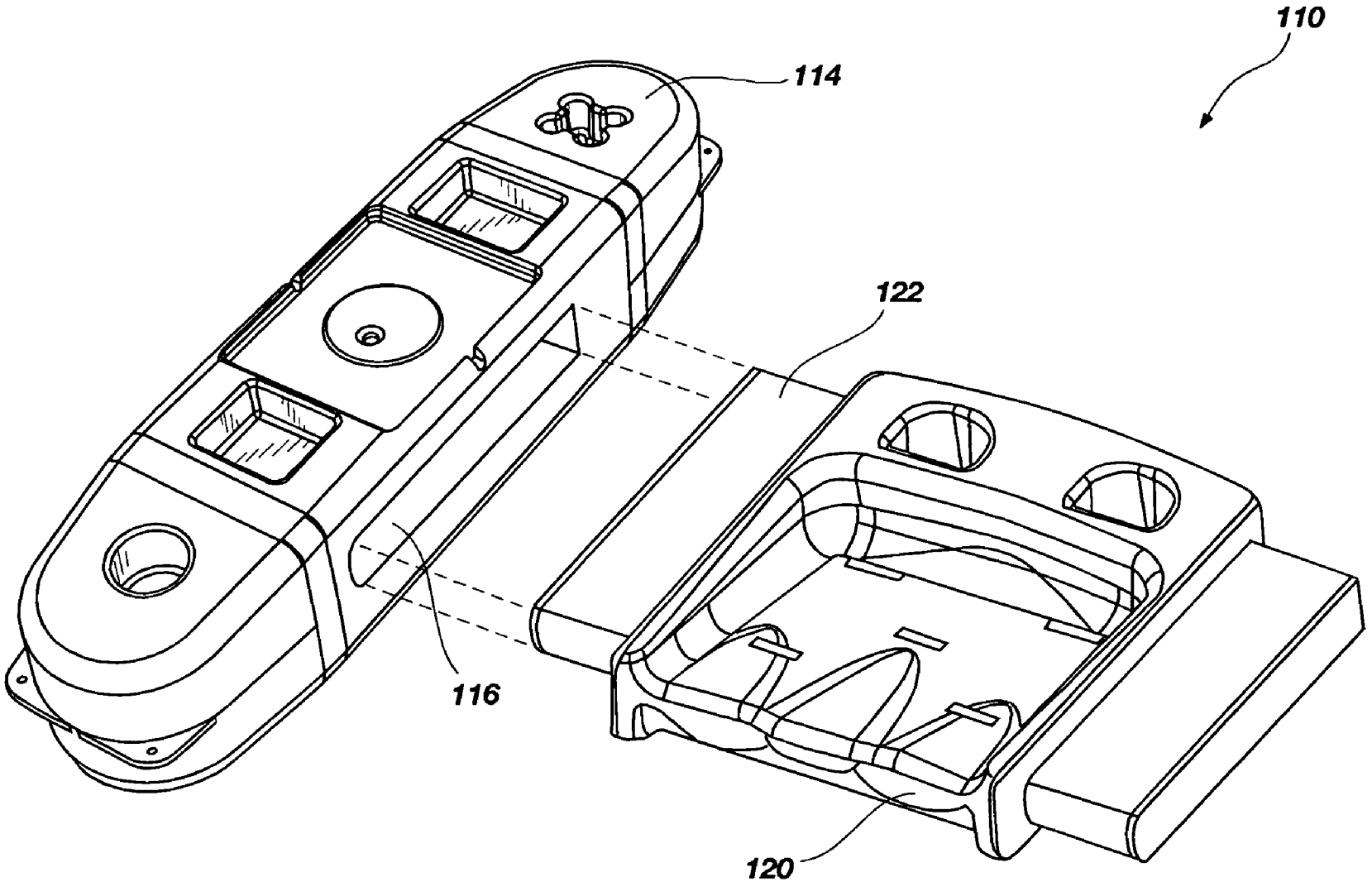
FIG. 9 illustrates an exploded perspective view of a seat module and a pontoon module in accordance with another exemplary embodiment of the present invention.

FIG. 9 is illustrative of another exemplary embodiment 110 of the present invention in which the connection interface between the seat module 120 and the pontoon module 114 is a single winglet 122 configured to fit into a side slot 116 in the pontoon module. The side slot can extend all the way through pontoon module, or can only extend as far as necessary to provide an adequate connection interface between the seat module and the pontoon modules.

Figure 10A:
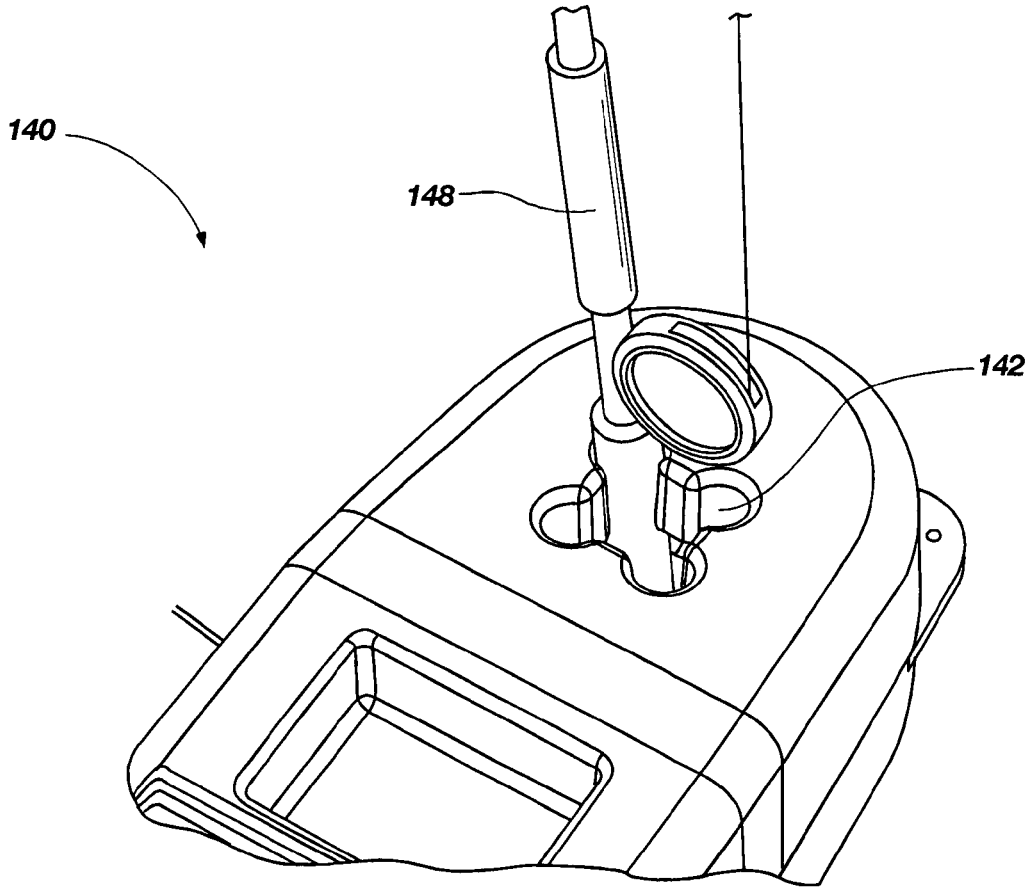
FIG. 10 illustrates a perspective view of a pontoon rod and net holder.
Figure 10B:
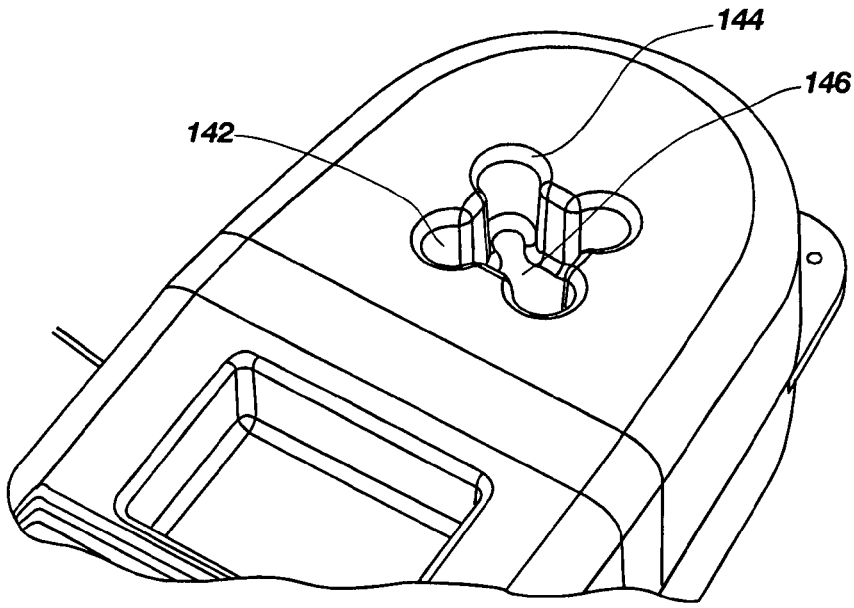

An additional aspect of a pontoon module 140 of the present invention is displayed in FIG. 10(*a*), in which a fishing tool 148 such as a fishing rod is received and removably secured by a rod and net holder 142. As further shown in FIG. 10(*b*), the rod and net holder 142 can have an asymmetric cloverleaf configuration in which a number of circular peripheral lobes 144 surround and connect with a central recess 146. The lobes can be of varying diameters to match the handle diameters of common fishing tools, such as fishing rods, fishing nets and the like. The lobes and central recess can also be formed with sufficient depth to secure a fishing tool that is simultaneously secured in the both the central recess and a peripheral lobe, such as a fly fishing rod and reel, wherein the reel is located at the base of the fly fishing rod and received partially within a lobe.

Figure 11:
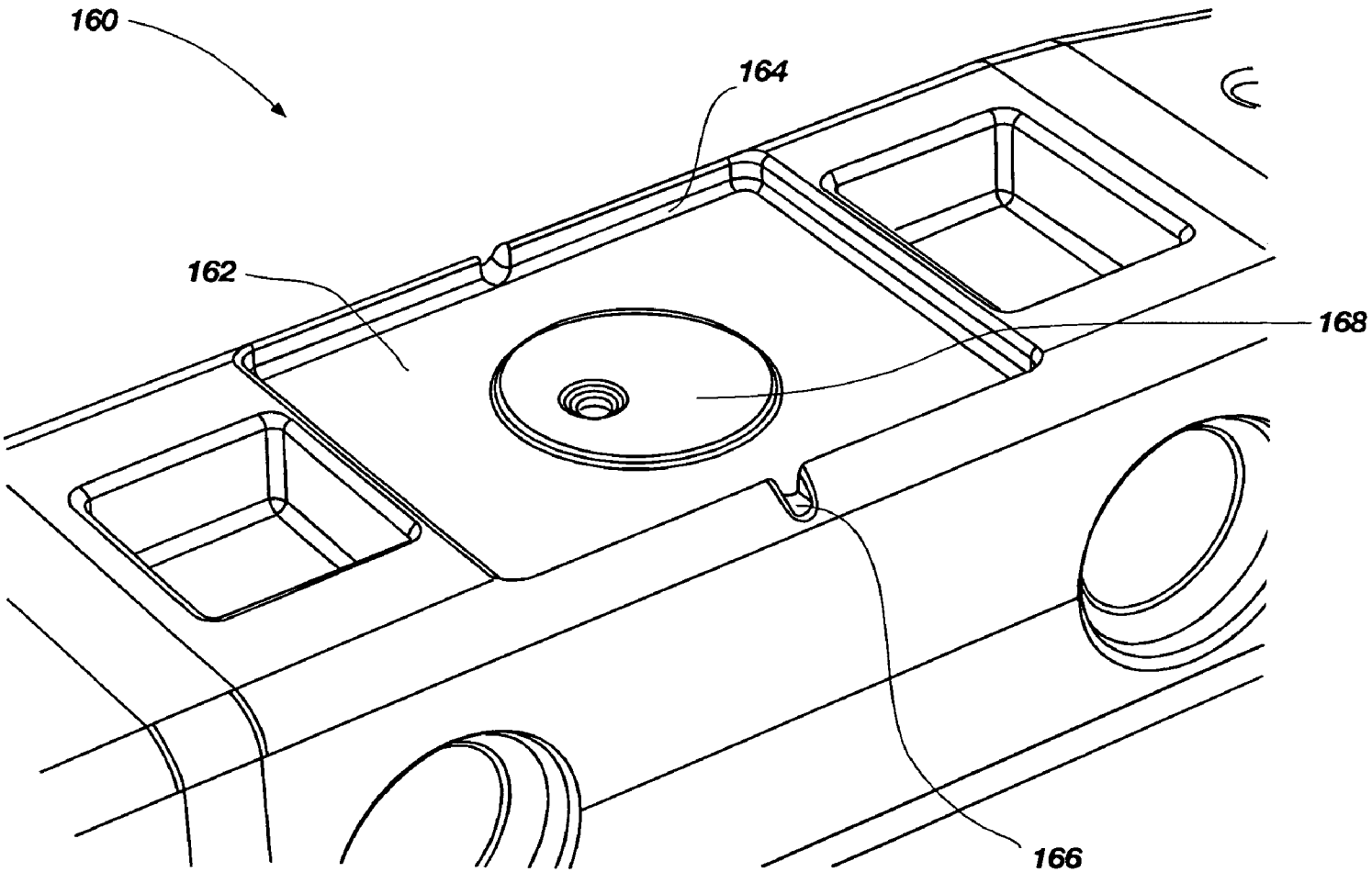
FIG. 11 illustrates a perspective view of a pontoon drain moat.

Another novel aspect of a pontoon module 160 of the present invention is illustrated in FIG. 11, in which a drain moat 164 is formed inside the perimeter walls former the ice chest and utility box recess 162. In an exemplary embodiment, the ice chest and utility box recess is located in a center portion of a pontoon module and can be the largest of the special recesses molded into the top surface of a pontoon module. The opening 168 to the dry storage compartment can be located within the ice chest and utility box recess. To ensure that no splash water is retained within the recess and allowed to seep into the dry storage compartment, the drain moat can be formed inside the perimeter walls bounding the recess and can be fluidly connected to one or more drain slots 166. The moat and the drain slots operate to direct away any water that may splash into the recess and to prevent any water or moisture from seeping down onto the contents or valuables stored underneath, as well as to quickly drain water that may otherwise fill the interior of the pontoon module.

Figure 12A:
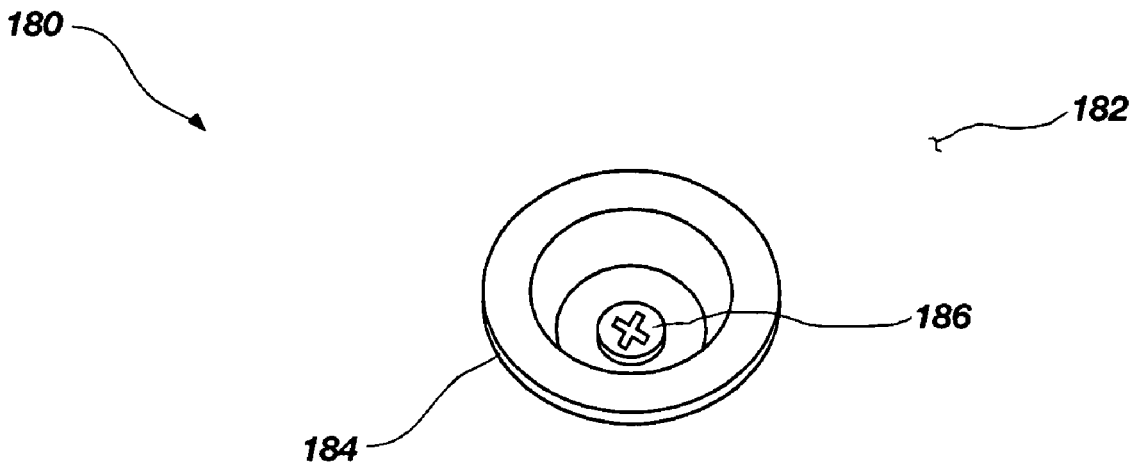
FIG. 12 illustrates a perspective and cross-sectional view of a pontoon bleeder valve.
Figure 12B:
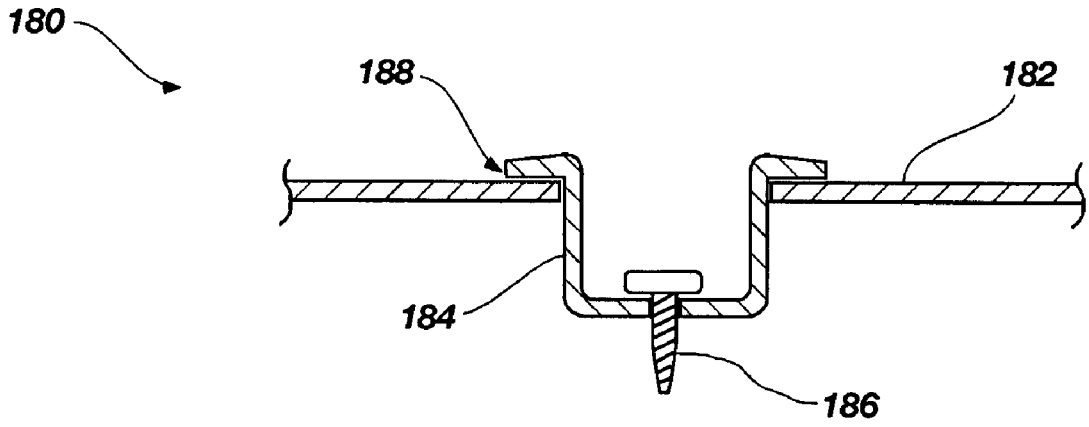

FIG. 12(*a*) and FIG. 12(*b*) illustrate a bleeder valve assembly 180 according to one exemplary embodiment. Indeed, the pontoon modules may also comprise one or more vent holes formed in their wall 182 designed to facilitate the intake or purging of air. One or more fittings may be used to seal the vent holes and to prevent water from entering the vent holes during use of the kick boat. The fittings may be comprised of a sealing plug, such as freeze plug 184, bonded into the vent hole with a bonding material 188, with a central bleeder screw 186 or bleeder valve that can be selectively removed by the user to allow the pontoon internal air pressure to equalize with ambient air pressure. As shown, the bleeder valve comprises a freeze plug having a recessed portion and an aperture formed in the recessed portion. A separate bleeder screw is operable with and removable from the aperture in the freeze plug to selectively open or seal the aperture, and thus to facilitate the intake or purging of air from the pontoon modules.

Figure 13:
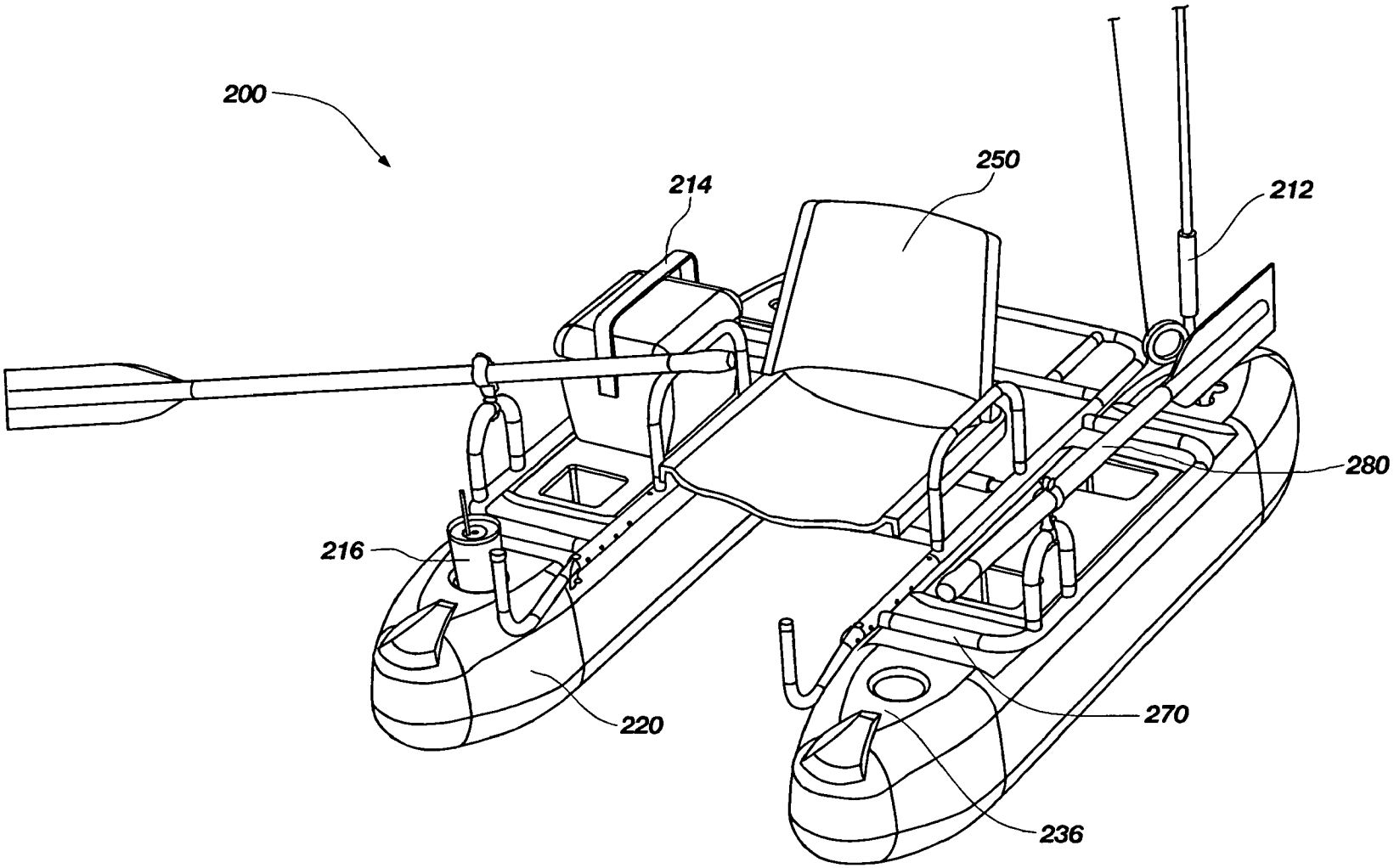
FIG. 13 illustrates a perspective view of a modular pontoon boat in accordance with another exemplary embodiment of the present invention.

Another exemplary embodiment 200 of the modular personal flotation system of the present invention is illustrated in FIG. 13. This embodiment is similar to those discussed above in that it also comprises first and second rigid pontoon modules 220 and a seat module or seat assembly 250. However, a frame module 270 has been interposed between the pontoon modules and the seat module to allow for additional features and advantages, such as a higher elevation of the seat module to facilitate the operation of a pair of oars 280. The pontoon modules themselves can be larger to create the greater buoyancy force required by the higher seat module location. The frame module can attach to the top surface 236 of the pontoon modules and can be made of metal to provide the necessary strength and rigidity to function as an alternative connection interface between the pontoon modules and the seat module. Furthermore, and similar to the previously discussed embodiments, the top surface of the pontoon module can be formed with a variety of specialized recesses for securing and keeping readily available equipment and gear commonly used by sport fishermen, such as a fishing rod 212, an ice chest 214 or a drinking cup 216.

Figure 14:
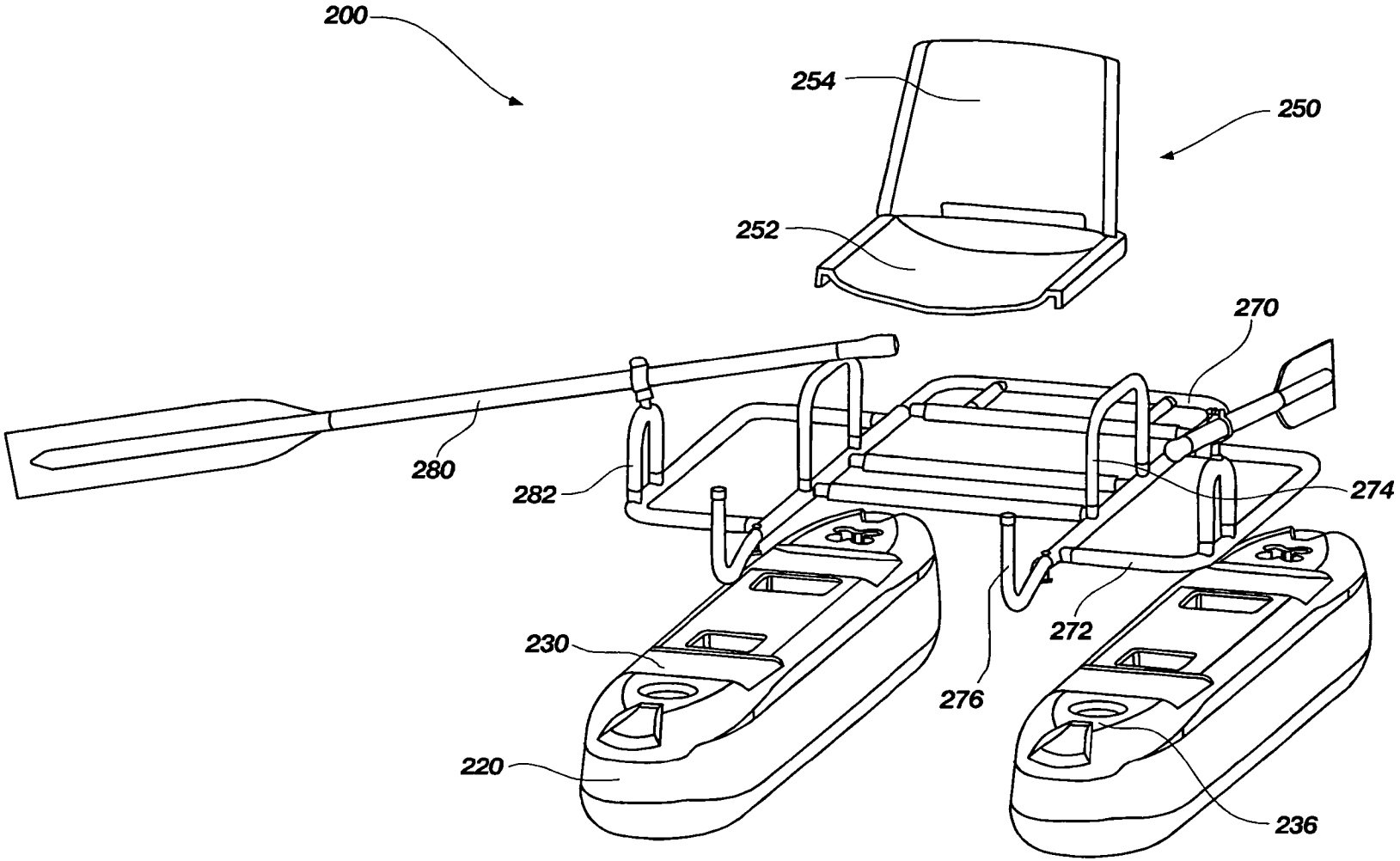
FIG. 14 illustrates an exploded, perspective view of the embodiment shown in FIG. 13.

FIG. 14 is an exploded view of the embodiment 200 shown in FIG. 13 and is illustrative of the features provided by a frame module 270 interposed between the seat module 250 and the pontoon modules 220. The use of a intermediate frame module allows the seat module to be positioned above the pontoon modules and at a location further removed from the water, which can be advantageous if the user desires to stay dry when fishing. Moreover, the use of a metal frame module which may be configured to be stronger and stiffer than a molded structure of equivalent size allows the pontoon modules to be larger and spaced further apart. In an exemplary embodiment the frame module is made from aircraft quality aluminum segments that have been TIG welded together to form a strong, structurally rigid support structure.

While the user is still close enough to the water to propel the boat using swimming fins or flippers, the additional height of the seat module and width between the pontoon modules can allow the user to generate sufficient leverage to operate a pair of oars 280. The oars can be mounted on oar supports 282 which can be located on the periphery of the frame to maximize the mechanical advantage to the user. In addition, the frame module can provide a pair of foot rests 276 to help the user apply more force when operating the oars, or simply to support the legs in a relaxed position while drifting. The foot rests can be adjustable such that the occupant may move them both forward and back to find the most comfortable position as well as pivot them out of the way if the user decides to place his feet in the water. The frame module can also provide a pair of arm rests 274.

As the seat module is entirely above the water and does not contribute to the buoyancy of the exemplary embodiment illustrated in FIG. 14, the seat module can be made with different configurations and materials. For instance, the seat module can be constructed with a folding seat back 254 that collapses against the seat bottom 252 when the pontoon boat is place in storage. And as it is less likely to come into contact with the water, the seat back can be padded to provide additional comfort to the occupant. The seat bottom can be attached to the frame module by any standard fastening method, including bolting and welding.

The configuration of the pontoon modules can also be modified to reflect the changes in the connection interface between the frame module and the pontoon modules. The top surface of the module 236 can be configured with a flat recess or support groove 230 to accommodate a support section 272 of the frame module. In the exemplary embodiment, the support groove is continuous from one side of the pontoon module to the other and with a length suitable enough to permit a short amount of front-to-back movement of the frame module within the groove. This front-to-back play in the location of the frame module on top of the pontoon modules allows the user to make trim adjustments and ensure that the frame and seat modules ride level on the pontoon modules.

The frame module can be removably coupled to the pontoon module using a connection interface comprised of different types, such as a flexible strap having hook and loop, snaps, buckles, or other similar types of fasteners operable therewith (not shown). For instance, the first and second rigid pontoon modules may be connected to the frame module by a system of low-cost nylon straps having hook and loop-type fastening strips, making for a secure assembly during use, while also enabling quick disassembly for transport or storage purposes. In another embodiment, the first and second pontoon modules may be coupled to the frame module using a strap having one or more cam-lock metal buckles. Those skilled in the art will recognize the many different types of connections that may be used.

Figure 15:
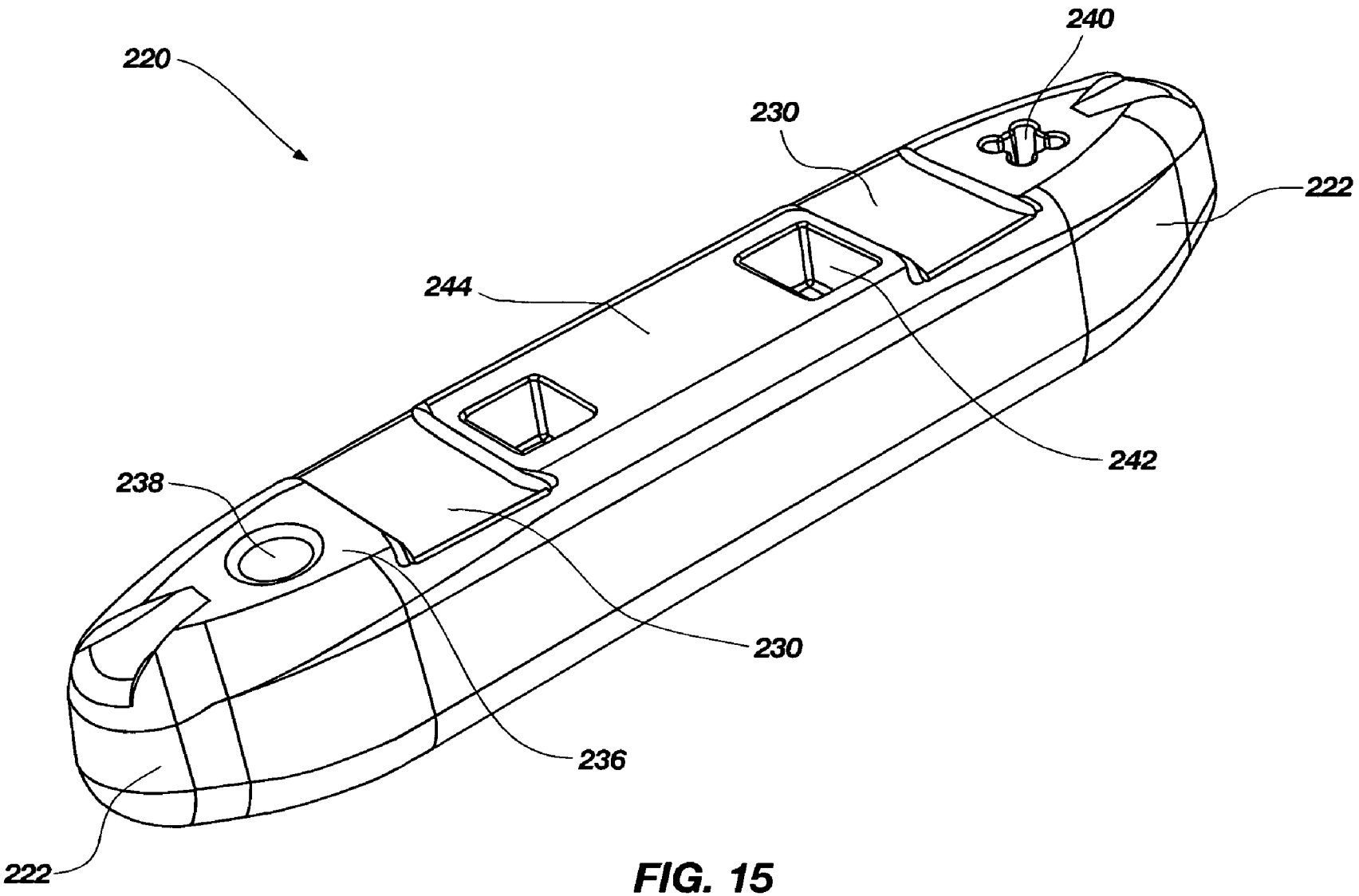
FIG. 15 illustrates a perspective view of a pontoon module in accordance with the embodiment of FIG. 13.

The rigid pontoon module 220 of the embodiment illustrated in FIG. 13 is shown in FIG. 15. As described hereinbefore, the pontoon modules each comprise a wall that defines their shape and internal cavity and are extremely resistant to punctures. The pontoon modules can be made of a thermoplastic material using rotational molding, blow molding or other similar process. The pontoons modules are capable of indefinitely retaining the air within their cavities and require no inflation. In addition, the walls can withstand relative pressure changes without substantial change or deformation in their shape.

The top surface 236 of each pontoon module is contoured to be parallel to the water surface, and is uniquely equipped with specialized recesses to receive and stabilize equipment such as a fishing pole, a fish net, a small plastic tackle box, a fish finder, a dry box, a six-pack beverage cooler, and/or a cup or mug. These recesses can include a cup holder 238, a rod and net holder 240, a storage bin 242, and an ice chest/utility box holder 244. The top surface can also be configured with two support grooves 130 which contact and removably couple the frame module, as previously described.

Moreover, the pontoon modules may also be formed so as to comprise different sized and configured compartments molded inside the pontoon, such as a dry storage compartment (not shown) which is accessible through a friction plug (not shown). The recesses may be used to secure and protect various items such as clothing or valuables from accidental loss or moisture.

The end sections 222 of the pontoon modules taper to rounded, blunt ends that enable the pontoon boat to be more easily propelled through the water via flippers or oars. As both ends of the pontoon modules are given the identical shape, the distinction between a bow end and a stern end is removed and the pontoon modules perform equally well during movement about the water in either direction. Moreover, the symmetrical configuration of the end sections allows the pontoon modules to be interchanged side to side and reversed front to back, as discussed above in relation to FIGS. 1-12.

The foregoing detailed description describes the invention with reference to specific exemplary embodiments. However, it will be appreciated that various modifications and changes can be made without departing from the scope of the present invention as set forth in the appended claims. The detailed description and accompanying drawings are to be regarded as merely illustrative, rather than as restrictive, and all such modifications or changes, if any, are intended to fall within the scope of the present invention as described and set forth herein.

More specifically, while illustrative exemplary embodiments of the invention have been described herein, the present invention is not limited to these embodiments, but includes any and all embodiments having modifications, omissions, combinations (e.g., of aspects across various embodiments), adaptations and/or alterations as would be appreciated by those in the art based on the foregoing detailed description. The limitations in the claims are to be interpreted broadly based on the language employed in the claims and not limited to examples described in the foregoing detailed description or during the prosecution of the application, which examples are to be construed as non-exclusive. For example, in the present disclosure, the term "preferably" is non-exclusive where it is intended to mean "preferably, but not limited to." Any steps recited in any method or process claims may be executed in any order and are not limited to the order presented in the claims. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus function are expressly recited in the description herein. Accordingly, the scope of the invention should be determined solely by the appended claims and their legal equivalents, rather than by the descriptions and examples given above.

What is claimed and desired to be secured by Letters Patent is:

1. A modular personal flotation system comprising:

first and second rigid pontoons, each having non-directional end sections and an integrally-formed pontoon connection interface located off-center at opposing, unequal distances relative to a midpoint of said pontoon;

a seat having a plurality of integrally-formed seat connection interfaces that interrelate with said pontoon connection interfaces of said first and second pontoons to provide multiple connection configurations; and a trim adjustment system comprising said rigid pontoons, each being individually and selectively reversible front to back as coupled to said seat, and said seat having a centerline positionable in one of a plurality of available positions relative to said midpoint of said pontoons, wherein said first and second pontoons and said seat directly interconnect in one of said plurality of connection configurations to form said modular personal flotation system and to provide a plurality of selectable trim adjustment settings.

2. The modular personal flotation system of claim 1, wherein said seat comprises:

a seat bottom having an additional integrally-formed connection interface, and a detachable seat back having an integrally-formed connection interface that interrelates with said additional integrally-formed connection interface.

3. The modular personal flotation system of claim 2, wherein said seat bottom is hollow and continuously contacts a surface of the water during normal operation of said flotation system to forms a buoyant portion of said flotation system.

4. The modular personal flotation system of claim 2, wherein said first and second rigid pontoons and said seat each comprise a unitary body formed from a polymer material.

5. The modular personal flotation system of claim 1, wherein said pontoons are interchangeable side to side.

6. The modular personal flotation system of claim 1, wherein said respective pontoon connection interface of each of said first and second pontoons comprises at least one sealed interior passage formed in a sidewall of said pontoon module.

7. The modular personal flotation system of claim 6, wherein each of said plurality of seat connection interfaces of said seat comprises a connection post extending from said seat and configured to be received within one of said interior passages.

8. The modular personal flotation system of claim 7, wherein said connection posts are formed on a downward incline to initially orient said pontoons on an incline and to facilitate leveling of said pontoons under a load as applied to said seat bottom.

9. The modular personal flotation system of claim 7, wherein each of said connection posts comprises a threaded end.

10. The modular personal flotation system of claim 9, further comprising a threaded connector adapted to engage said threaded ends of said connection posts to couple together said seat and said first and second pontoons.

11. The modular personal flotation system of claim 1, wherein said pontoons requite no inflation and have a shape resistant to relative pressure changes.

12. The modular personal flotation system of claim 1, wherein said pontoons have at least one bleeder valve assembly for equalization of internal pressure with ambient conditions.

13. The modular personal flotation system of claim 1, wherein said pontoons further comprise a drain moat formed in a top surface for directing splash water off said top surface.

14. The modular personal flotation system of claim 1, wherein said pontoons further comprise an asymmetric cloverleaf rod and net holder formed in a top surface to receive and removably secure a fishing tool.

15. The modular personal flotation system of claim 1, wherein said pontoons each further comprise a thin-wall makeup defining a sealable and accessible hollow interior volume of space to secure and protect at least one article from moisture.

16. A method of assembling a modular personal flotation system comprising:

obtaining first and second rigid pontoons, each having non-directional end sections and an integrally-formed pontoon connection interface located off-center at opposing, unequal distances relative to a midpoint of said pontoon;

obtaining a seat having a plurality of integrally-formed seat connection interfaces that interrelate with said pontoon connection interfaces of said pontoons to form a trim adjustment system comprising said rigid pontoons, each being individually and selectively reversible front to back as coupled to said seat;

interconnecting said pontoon connection interfaces of said pontoons directly with said seat connection interfaces of said seat in a first connection configurations to form said modular personal flotation system, said centerline of said seat being positioned offset a first distance relative to said midpoint of said pontoons to provide a first selectable trim adjustment setting; and interconnecting said pontoon connection interfaces of said pontoons directly with said seat connection interface of seat in a second connection configuration to form said modular personal flotation system, said centerline of said seat being positioned offset a second distance relative to said midpoint of said pontoons to provide a second selectable trim adjustment setting.

17. A modular personal flotation system comprising:

first and second rigid pontoons, each having non-directional end sections and an integrally-formed pontoon connection interface;

a seat;

a seat connection interface interrelating with said pontoon connection interfaces of said first and second pontoons to secure said seat with said first and second pontoons in one of a plurality of connection configurations to form said modular personal flotation system; and a trim adjustment system comprising said first and second rigid pontoons and said seat being adjustable relative to one another to provide a plurality of selectable trim adjustment settings, said seat having a centerline positionable in one of a plurality of available positions relative to said midpoint of said pontoons.

18. The modular personal flotation system of claim 17, wherein said first and second pontoons each further comprise a thin-wall makeup defining a sealable and selectively accessible hollow interior volume of space to secure and protect at least one article from moisture.

19. The modular personal flotation system of claim 17, wherein said seat connection interface comprises a frame.

20. The modular personal flotation system of claim 19, wherein said pontoon connection interfaces comprises a front and a rear non-specific recess formed in a top surface to receive said frame, said frame being movable front to back within said non-specific recesses to provide said plurality of selectable trim adjustment settings.

21. The modular personal flotation system of claim 20, wherein each of said first and second pontoons are individually and selectively reversible front to back as provided by said non-specific end sections.

22. A modular personal flotation system comprising:

first and second rigid pontoons, each having non-directional end sections and a front and a rear non-specific recess formed in a top surface of said pontoon;

a seat;

a frame interfacing with said front and rear non-specific recesses of said first and second pontoons to secure said seat with said first and second pontoons in one of a plurality of connection configurations to form said modular personal flotation system, and a trim adjustment system comprising said frame and said front and rear non-specific recesses of said first and second pontoons being adjustable to provide a plurality of selectable trim adjustment settings, said frame being movable within said non-specific recesses and having a centerline positionable in one of a plurality of available positions relative to midpoints of said first and second pontoons.

* * * * *